US006026929A

United States Patent [19]

Faraone

[11] Patent Number: 6,026,929

[45] Date of Patent: Feb. 22, 2000

[54] HIGH FREQUENCY RADIALLY ARCUATED CENTER SPEAKER CONE WITH VARIABLE THICKNESS

[75] Inventor: Alexander Faraone, Frenchtown Township, Hunterdon County, N.J.

[73] Assignee: Single Source Technology and Development, Inc., Maple Shade, N.J.

[21] Appl. No.: 09/168,255

[22] Filed: Oct. 8, 1998

Related U.S. Application Data

[63] Continuation-in-part of application No. 08/967,699, Nov. 12, 1997, Pat. No. 5,847,332, and application No. 08/967,738, Nov. 12, 1997, Pat. No. 5,880,412.

[51] Int. Cl.[7] ..... C10K 13/00

[52] U.S. Cl. ..... 181/173; 181/163; 181/164; 181/174

[58] Field of Search ..... 181/157, 163, 181/164, 169, 170, 173, 174, 167; 381/398, 423, 424, 430, 432

[56] References Cited

U.S. PATENT DOCUMENTS

| | | | |
|---|---|---|---|
| 1,699,786 | 1/1929 | Goldsborough | 181/173 |
| 1,757,107 | 5/1930 | Baltzley . | |
| 1,787,946 | 1/1931 | La Rue . | |
| 4,013,846 | 3/1977 | Krawczak et al. . | |
| 4,300,655 | 11/1981 | Sakamoto et al. . | |
| 4,655,316 | 4/1987 | Murray . | |
| 4,811,403 | 3/1989 | Henrickson . | |
| 4,862,508 | 8/1989 | Lemon . | |
| 4,881,617 | 11/1989 | Faraone . | |

*Primary Examiner*—Khanh Dang
*Attorney, Agent, or Firm*—Kenneth P. Glynn, Esq.

[57] ABSTRACT

The present invention is directed to an improved high frequency acoustic speaker center cone, which may be located at a speaker coil tubular support, tube wherein the cone has a plurality of thin, pie-shaped segments radiating outwardly with each of the segments having an arcuated cross-section, so as to create a convex shape towards its center. The segments are highly concave toward the center and less concave with increasing radial distance away from the center. The width of the segments may increase linearly with radial distance so as to create a constant acoustical resistance radially. The center cone also has a thickness gradient with increasing thickness radially towards its center. In another embodiment, the present invention is directed to a system containing both the aforesaid center cone, an outer cone with similar radial characteristics but being concave towards its center. The segments of the outer cone preferably terminate at a flexible, high sound absorption ring. The center cone fits within an orifice at the center of the outer cone.

20 Claims, 3 Drawing Sheets

HIGH FREQUENCY RADIALLY ARCUATED CENTER SPEAKER CONE WITH VARIABLE THICKNESS

REFERENCE TO RELATED APPLICATIONS AND INCORPORATION BY REFERENCE

This patent application is a continuation-in-part of U.S. patent application Ser. No. 08/967,699, now U.S. Pat. No. 5,847,332, entitled "Polycarbonate-Based Radially Arcuated Speaker Cone" and U.S. patent application Ser. No. 08/967,738, now U.S. Pat. No. 5,880,412 entitled "High Frequency Radially Arcuated Center Speaker Cone", both applications of which were filed in the United States Patent and Trademark Office on Nov. 12, 1997. Both applications are incorporated herein by reference.

BACKGROUND OF THE INVENTION

1. Field of the Invention

The present invention relates to acoustic speakers and particularly to high frequency speakers which have cones with arcuated segments which extend radially which have a thickness gradient with increasing thickness radially towards its center. Thus, the present invention is directed to the pursuit of constant wave velocity generation for accurate sound reproduction at high frequencies utilizing three dimensionally defined variable thickness cones.

2. Information Disclosure Statement

The function of cones in speakers is well known and it has been accepted that a coil generates sound waves radially over a speaker cone, typically made of material capable of vibration when properly mounted. The cones were originally named as such due to the slightly "conical", configuration.

Early speaker designs are exemplified by U.S. Pat. No. 1,757,107 to Baltzley which teaches a sound generator, a tympanum having undulations extending from the central portion to the rim of the tympanum and gradually increasing in depth and width from such central portion outwardly toward the rim portion of the same and a connection for bodily vibrating said tympanum, said connection being rigidly engaged with an intermediate portion of the tympanum and supporting the tympanum for vibration in free air responsive to the movements of said connection.

U.S. Pat. No. 1,787,946 to LaRue wherein a suspended diaphragm is used. However, conventional acoustic speakers involved diaphragms of the aforesaid basic conical design wherein it radiated outwardly about a coil. Subsequent improvements led to the acoustic diaphragm having a honeycomb cone, e.g. of a plurality of laminated metal foils, the adjacent metal foils being adhered at a regular pitch.

U.S. Pat. No. 4,013,846 to Krawczak describes an electroacoustic loudspeaker having a rigid, lightweight diaphragm and a substantially closed loop magnet support of a magnetically permeable material having a channel-shaped cross-section and supported adjacent and spaced from the diaphragm with the open side of the channel facing the diaphragm. The magnet support carries a pair of magnets magnetized and positioned with opposite poles in spaced facing relation and a voice coil is secured to the diaphragm and lies in the gap between the magnets.

U.S. Pat. No. 4,300,655 to Sakamoto et al describes an acoustical diaphragm which is made of a cone member of elongated web material bent to have a plurality of radial projections sandwiched between upper and lower flat components. It is indicated by the invention therein that increased speaker power is achieved due to model line reshaping. While this patent is concerned with radial sound wave generation it is not directed to the type of system represented by the present invention wherein constant wave velocities are sought at high frequencies utilizing arcuated speaker segments which tend towards flattening as the radial distance increases.

U.S. Pat. No. 4,655,316 to Murray describes an acoustic diaphragm which is made of metallic sheet material forming a raised pattern of the material and unraised sectors of the material. The diaphragm is of the dome-shaped variety. The raised pattern incorporates sets of raised strip elements. There is a set of such elements extending radially from the vicinity of the apex. There is a set extending along areas of the sheet material between the radially extending elements, this second set including pairs of strip elements, this second set including pairs of strip elements which intersect one another along such areas. There is also a set of circumferentially extending raised strip elements. The form of the radially extending elements changes along their lengths; for example, they rise to levels which vary along their lengths.

U.S. Pat. No. 4,811,403 illustrates various types of horns for ultralight loudspeakers. This patent describes a loudspeaker and enclosure assembly which includes a load bearing member exhibiting good thermal conductivity; at least one loudspeaker mounted on the load bearing member and in thermal engagement therewith; and its enclosure having walls formed of rigid lightweight material mounted on the load bearing member to enclose the at least one loudspeaker, whereby the assembly is easily moved and mounted and thermal energy generated by operation of the loudspeaker is effectively dissipated through the load bearing member. The enclosure may be a rigid foam-filled member defining a generally funnel-shaped bore therein to form a horn for the loudspeaker, whereby a modular construction of interchangeable integrally formed enclosures and horns can be achieved. However, this patent does not show the type of arrangement or assembly specifically claimed herein.

U.S. Pat. No. 4,862,508 to Lemon describes an improved method for transmitting sound at high power levels over a wide angle zone of dispersion without distortion, comprising the step of emitted sound waves from a plurality of individual sources, each characterized by a relatively narrow, wedge-shaped envelope of sound projection, such that adjacent edges of respective sound projection envelopes are in substantial alignment and do not overlap, whereby the absence of interferences between sounds emitted from different sources precludes sound distortion and enables uniform sound dispersion and high sound quality throughout the zone. The sound waves are preferably emitted from electroacoustical loudspeakers having loudspeaker enclosures shaped to conform to the edges of their respective sound envelopes.

U.S. Pat. No. 4,881,617 to Alexander Faraone describes an acoustic speaker having a cone located about a transducer wherein the cone has a plurality a thin, pie-shaped segments radiating outwardly from the transducer with each of the segments having an arcuated cross-section, thereby creating a concave side and a convex side.

The above-described patent to Alexander Faraone, the inventer herein, is directed to cones having configurations which are concave towards the center whereas the present invention high frequency center cone has other unique and unobvious characteristics, including being convex towards it center, being unistructurally formed and being located about a voice coil support tube in a different manner.

Notwithstanding the prior art, the present invention is neither taught nor rendered obvious thereby.

SUMMARY OF THE INVENTION

The present invention is directed to an improved high frequency acoustic speaker center cone, which may be located at a speaker coil tubular support, tube wherein the cone has a plurality of thin, pie-shaped segments radiating outwardly with each of the segments having an arcuated cross-section, so as to create a convex shape towards its center. The segments are highly concave toward the center and less concave with increasing radial distance away from the center. The width of the segments may increase linearly with radial distance so as to create a constant acoustical resistance radially. The center cone also uniquely has a thickness gradient with increasing thickness radially towards its center. In another embodiment, the present invention is directed to a system containing both the aforesaid center cone, and an outer cone with similar radial characteristics but being concave towards its center. The segments of the outer cone preferably terminate at a flexible, high sound absorption ring. The center cone fits within an orifice at the center of the outer cone.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

As mentioned in the Information Disclosure Statement above, the present inventor has received U.S. Pat. No. 4,881,617 which describes unique acoustical speakers utilizing three dimensionally defined radially arcuated cones.

The present invention involves a substantial improvement over the prior art speakers of U.S. Pat. No. 4.881,617 because it was not recognized at that time that a center cone should be formed unistructurally with a reverse configuration (convex towards the center instead of concave towards the center) with no alternative center materials. While the Faraone patent describes the possibility of center cones as diaphragms, dust covers or cones having a similar design to the main cone with a small piece of sound absorbing material as a terminus, it does not recognize the need for unistructurally formed center cones of one consistent material of construction to enhance high frequency, high quality sound generation. In other words, this present invention center cone is devoid of any padding, alternative materials, cushions or other materials and uniquely generates high frequency waves. In fact, the inventor herein created a cone made of metal foil with a center hole with a foam pad therein consistent with line 25 through 37 of column 3 of U.S. Pat. No. 4,881,617 and found that, after years of further development, this center cone created in accordance with his earlier patent was significantly inferior to the present invention center cone. It created some undesirable resonances and could not carry 20,000 cycles Hertz, whereas the present invention high frequency center cone unexpectedly overcame both of these difficulties.

Further, it was more recently discovered that the present invention center cone has increased range by being formed with a thickness gradient which increases radially towards its center.

Figure 2A:
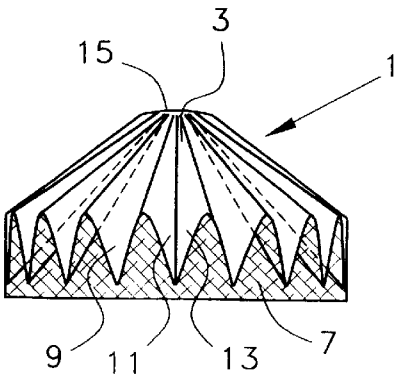
Figure 2B:
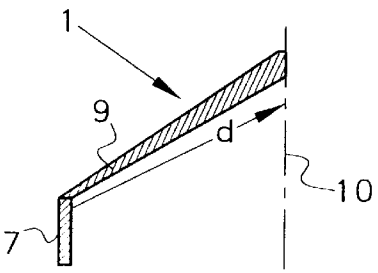
FIG. 2B shows a side cut view of one portion of the center cone of FIGS. 1 and 2A.
Figure 2C:
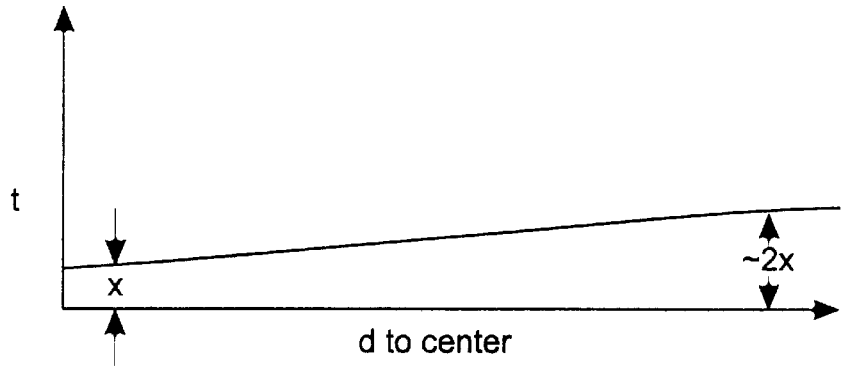
FIGS. 2C, 2D, 2E and 2F graphically illustrate a sampling of different thickness gradients which may be used in the center cones of the present invention.
Figure 2D:
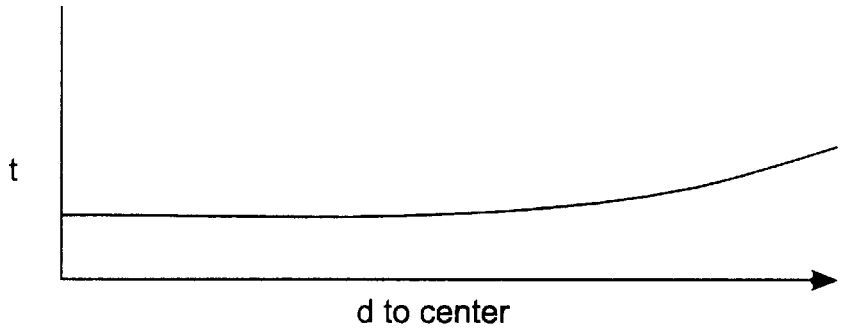
Figure 2E:
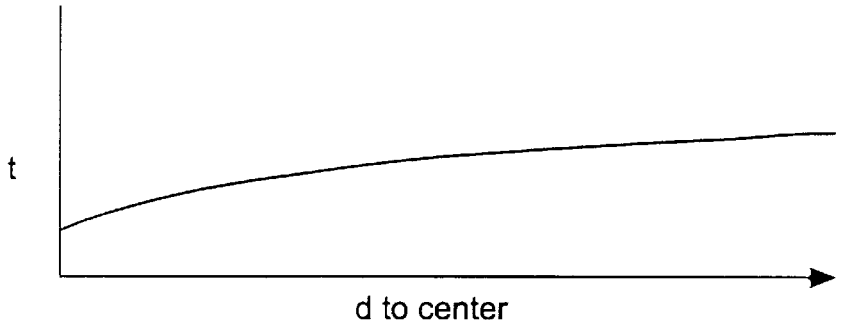
Figure 2F:
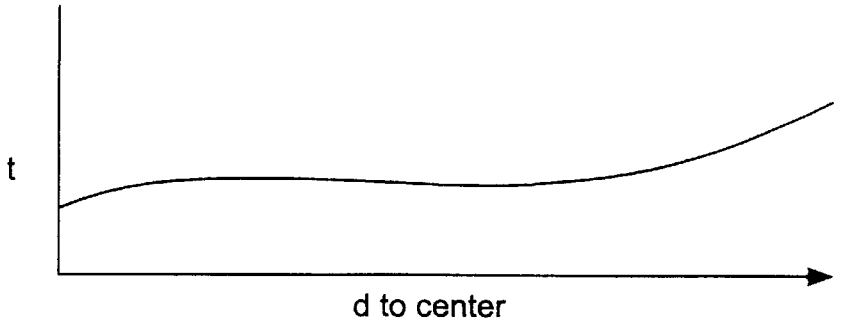

FIGS. 2C, 2D, 2E and 2F graphically illustrate various thickness gradients which may be utilized with the present invention center cones. FIG. 2C shows a linearly increasing thickness; FIG. 2D shows an initially flat line thickness followed by a geometrically increasing thickness; FIG. 2E shows an initially geometrically increasing thickness followed by linearly increasing thickness and FIG. 2F shows first geometric, then flat, then reversed geometric thickness. Linear and linear followed by a geometric are preferred.

Additionally, in preferred embodiments of the present invention, the unistructurally formed center cone includes a cylindrical portion developed to fit on the inside or on the outside of speaker coil support tubes. In preferred embodiments, it is located within these tubular support members.

The high frequency center cone of the present invention may be used alone or with other speakers by being mounted within a central orifice of other speaker configurations. In preferred embodiments, the high frequency center cone of the present invention is combined with the previously designed larger Faraone cone (outer cone) to create a high quality, extremely broad range, acoustical speaker.

Figure 1:
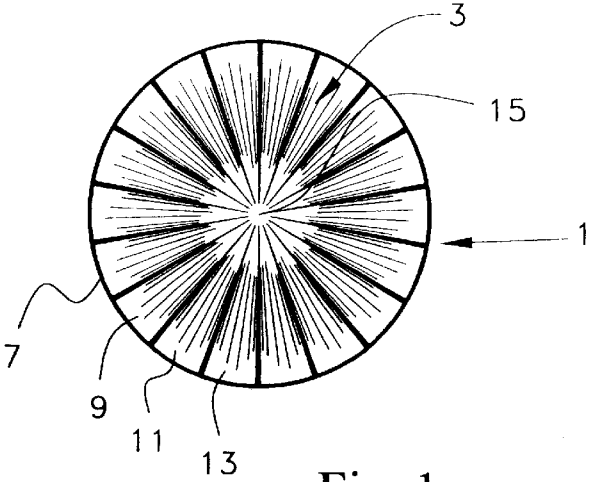
FIGS. 1 and 2A show front and side views of one preferred embodiment of a present invention high frequency center cone.

Referring now to FIGS. 1 and 2A, there is shown a front view and a side view, respectively, of a present invention high frequency center cone 1. Center cone 1 is formed of clear polycarbonate plastic, known as Lexan® Film 8010 and produced by General Electric Company of Pittsfield, Mass. (Lexan is a registered trademark of General Electric Company). Center cone 1 includes a front portion 3 which is generally convex towards its center (in other words, its most outwardly protruding aspect away from a speaker coil or transducer would be at its center). At the outer edge 5 of front portion 3 is a tubular wall 7, which maintains a circumferential base of support to front portion 3 and enhances attachment of center cone 1 to other components of an acoustical speaker system, such as a tubular support and/or an outer speaker. Individual segments, such as segments 9, 11 and 13 are pie-shaped segments which radiate outwardly from the center 15 of cone 1. All of these segments have an arcuated cross-section as clearly illustrated in FIG. 2, thereby creating a concave side and a convex side to each such segment. All of the concave sides face one direction and all of the convex sides of the segments face an opposite direction. Further, all of the arcuated segments have a highly concave cross-section toward the cone's center 15 and a less concave cross-section with increasing radial distance away from the center 15. Also, as can be seen, cone 1 itself is convex towards its center 15, i.e. it protrudes outwardly away from its wall 7.

FIG. 2A shows a side cut view of a portion of cone 1 shown in FIGS. 1 and 2A, at segment 9. The letter d indicates distance from side 7 to center line 10 and this distance is the x-axis in FIGS. 2C through 2F discussed below. Note that the thickness of segment 9 increases moving from wall 7 toward center line 10. This increasing thickness is a gradient consistent throughout cone 1 with thickness increasing radially towards the center.

Figure 3:
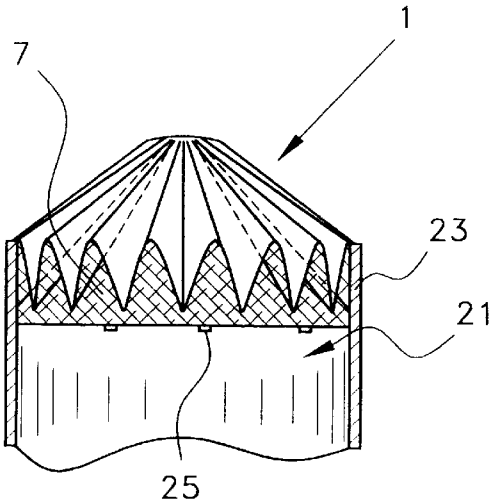
FIGS. 3 and 4 show side views of present invention center cones mounted on the inside and outside of a tubular support for a speaker coil, respectively.

FIG. 3 shows a side view of present invention center cone's mounted on the inside or outside of a tubular support for a speaker coil. In both FIGS. 3 and 4, center cone 1 is mounted to a speaker coil tubular support. In FIG. 3, center cone 1 is inserted on the inside of tubular support 21 with wall 7 of cone 1 being fitted on the inside of wall 23 of tubular support 21. Optional stops such as stop 25 may be used to position center cone 21 at the full depth of wall 7. It may otherwise be kept in place by adhesives and/or the mechanical structure of a speaker cabinet or encasement.

Figure 4:
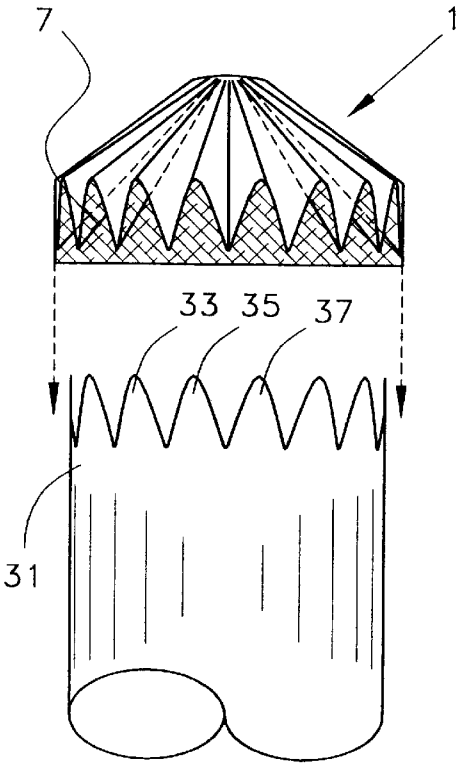

Alternatively, in FIG. 4, cone 1 is fitted to the outside of tubular support 31. In this case, tubular support 31 has an arcuated end with extensions 33, 35, 37, etc. to fit inside wall 7 and mesh with the wall portions which terminate the individual segments of center cone 1. This will permit maximum transmission of the sound waves from the tubular support 31 to center cone 1.

Figure 6:
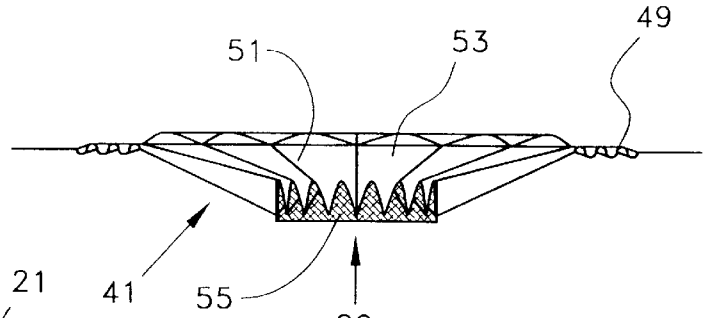
FIG. 6 illustrates a side cut view of the outer cone shown in FIG. 5; and, FIG. 7 illustrates a side cut view of a present invention acoustic speaker, including a center cone and an outer cone.
Figure 5:
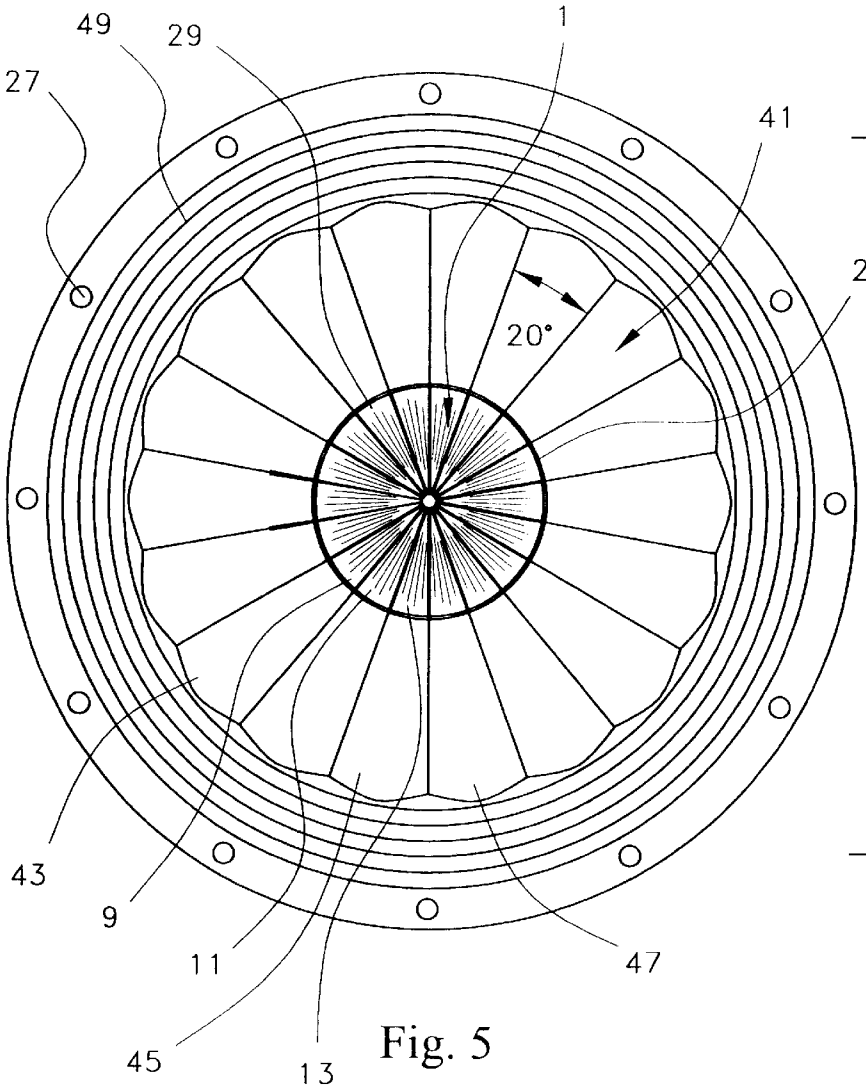
FIG. 5 shows a front view of a present invention speaker arrangement utilizing both the center cone and the outer cone.

FIG. 5 illustrates a front view of a present invention speaker arrangement utilizing center cone 1, as well as outer cone 41. With respect to outer cone 41 reference is made to both FIGS. 5 and 6. FIG. 6 shows a cut side view of only outer cone 41. FIG. 5 shows center cone 1 located on the inside of a speaker coil tubular support 21 and outer cone 41 located on the outside of tubular support 21. In this embodiment, outer cone 41 has individual segments evenly divided at 20° each and, hence, has a total of 18 segments. Likewise, center cone 1 has 18 corresponding segments. Outer cone 41 contains segments which have an arcuated cross-section, thereby creating a concave side and a convex side to each such segment, all of said concave sides of said segments facing one direction and all of said convex sides of said segments facing an opposite direction. Further, these arcuated segments, such as segments 43, 45 and 47, have a highly concave section towards the center and a less concave cross-section with increasing radial distance away from its center. This is particularly evident when viewing segments 51 and 53 of outer cone 41 shown in FIG. 6.

Figure 7:
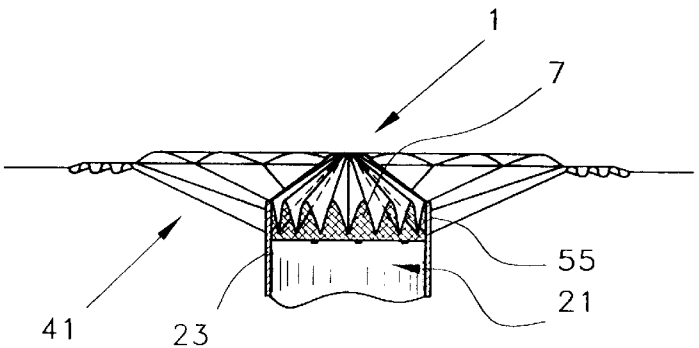

While center cone 1 is convex towards its center as illustrated in FIG. 2, outer cone 41 is concave towards its center as shown in FIG. 6, i.e. outer cone 41 protrudes backwardly towards its center. Additionally, outer cone 41 has an optional high sound absorption suspension ring 49 to permit more motion of outer cone 41 to thereby enhance performance. Mounting to a frame may be accomplished by screws through orifices such as orifice 27. Importantly, note that outer cone 41 has a central orifice 29 and an inside side wall 55 (FIG. 6). In this particular embodiment, outer cone 41 is made of the same material as inner cone 1. FIG. 7 shows a side cut view of the combination acoustic speaker shown in FIG. 5. (Identical parts throughout all of the Figures are identically numbered.)

All of the center cones in all of the Figures described above have a thickness gradient with increasing thickness toward the center. These gradients may be linearly increasing thicknesses, geometrically increasing thicknesses, or otherwise, as exemplified by FIGS. 2C through 2F, or otherwise, without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. In an acoustic speaker having a cone for conversion of electromechanical energy to high frequency sound, the improvement which comprises:

a cone having a plurality of thin, pie-shaped segments which radiate outwardly from the center of said cone, all of said segments having an arcuated cross-section, thereby creating a concave side and a convex side to each such segment, all of said concave sides facing one direction and all of said convex sides of said segments facing an opposite direction, and wherein all of said arcuated segments have a highly concave cross-section toward the cone's center and a less concave cross-section with increasing radial distance away from said center:

further wherein said cone is convex towards said center; and, further, wherein said cone has a thickness gradient with increasing thickness radially towards its center.

2. The acoustic speaker of claim 1 wherein said cone and its segments are all made from a single continuous sheet of unistructurally formed plastic.

3. The acoustic speaker of claim 1 wherein the arcuated segments have a lessening concave cross-section with increasing radial distance from the center of the cone whereby the width of the segment increases linearly with increasing radial distance so as to create constant acoustical resistance radially.

4. The acoustic speaker of claim 1 which further includes a hollow tubular speaker support, and said cone is fitted inside said support at an outer end of said support.

5. The acoustic speaker of claim 1 which further includes a hollow tubular speaker support, and said cone is fitted outside said support at an outer end of said support.

6. The acoustic speaker of claim 1 wherein said thickness gradient increases substantially linearly.

7. The acoustic speaker of claim 2 wherein said thickness gradient increases substantially linearly.

8. The acoustic speaker of claim 1 wherein said cone is formed of a polycarbonate-based plastic.

9. The acoustic speaker of claim 2 wherein said cone is formed of a polycarbonate-based plastic.

10. In an acoustic speaker for having a cone for conversion of electromechanical energy for sound, the improvement which comprises:

a.) a first cone, being a center cone, said center cone having a plurality of thin, pie-shaped segments which radiate outwardly from the center of said cone, all of said segments having an arcuated cross-section, thereby creating a concave side and a convex side to each such segment, all of said concave sides facing one direction and all of said convex sides of said segments facing an opposite direction, and wherein all of said arcuated segments have a highly concave cross-section toward the cone's center and a less concave cross-section with increasing radial distance away from said center, further wherein said cone is convex towards said center; and, further wherein said cone has a thickness gradient with increasing thickness radially towards its center; and, (b.) a second cone, being an outer cone, said outer cone having a central orifice, and said outer cone being concave towards its center, said outer cone having a plurality of thin pie-shaped segments which radiate outwardly from said transducer, each of said segments having an arcuated cross-section, thereby creating a concave side and a convex side to each such segment, all of said concave sides of said segments facing one direction and all of said convex sides of said segments facing an opposite direction, and further wherein said arcuated segments have a highly concave cross-section towards center and a less concave cross-section with increasing radial distance away from its center;

wherein said first cone is centrally located within said central orifice of said second cone.

11. The acoustic speaker of claim 10 wherein said segments of said outer cone terminate at a flexible, high sound absorption suspension ring.

12. The acoustic speaker of claim 10 wherein said center cone and its segments are all made from a single continuous sheet of unistructurally formed plastic.

13. The acoustic speaker of claim 10 wherein said outer cone and its segments are all made from a single continuous sheet of unistructurally formed plastic.

14. The acoustic speaker of claim 10 which further includes a transducer and a hollow tubular transducer support, and said center cone is fitted on said support and said outer cone central orifice contains said center cone and said support at an outer end of said support.

15. The acoustic speaker of claim 14 wherein said center cone is fitted inside said support.

16. The acoustic speaker of claim 14 wherein said center cone is fitted outside said support.

17. The acoustic speaker of claim 10 wherein said thickness gradient increases substantially linearly.

18. The acoustic speaker of claim 11 wherein said thickness gradient increases substantially linearly.

19. The acoustic speaker of claim 10 wherein said cone is formed of a polycarbonate-based plastic.

20. The acoustic speaker of claim 11 wherein said cone is formed of a polycarbonate-based plastic.

* * * * *